US005419748A

United States Patent [19]

Snyderman et al.

[11] Patent Number: 5,419,748

[45] Date of Patent: May 30, 1995

[54] ADJUSTABLE, MULTIPLE RESISTIVE FORCE EXERCISER

[75] Inventors: Fredric Snyderman, Sharon; Kasey Moulton, Somerville, both of Mass.

[73] Assignee: CSA, Inc., South Easton, Mass.

[21] Appl. No.: 287,714

[22] Filed: Aug. 9, 1994

Related U.S. Application Data

[63] Continuation of Ser. No. 48,211, Apr. 19, 1993, abandoned, which is a continuation of Ser. No. 868,988, Apr. 15, 1992, abandoned.

[51] Int. Cl.[6] ..... A63B 21/00

[52] U.S. Cl. ..... 482/52; 482/130; 482/123

[58] Field of Search ..... 428/51, 52, 53, 121, 428/122, 123, 111, 112, 130

[56] References Cited

U.S. PATENT DOCUMENTS

| | | | |
|---|---|---|---|
| 3,587,319 | 6/1971 | Andrews | 482/112 |
| 3,638,941 | 2/1972 | Kulkens | 482/130 |
| 4,204,676 | 5/1980 | Givens | 482/130 |
| 4,582,320 | 4/1986 | Shaw | 482/130 |
| 4,605,220 | 8/1986 | Troxel | 482/112 |
| 4,645,197 | 2/1987 | McFee | 482/130 |
| 4,684,125 | 8/1987 | Lantz | 482/112 |
| 4,796,881 | 1/1989 | Watterson | 482/130 |
| 4,989,858 | 2/1991 | Young et al. | 482/53 |
| 5,071,115 | 12/1991 | Welch | 482/52 |
| 5,129,872 | 7/1992 | Dalton et al. | 482/52 |
| 5,254,059 | 10/1993 | Arthur et al. | 482/52 |

*Primary Examiner*—Stephen R. Crow
*Attorney, Agent, or Firm*—Herbert L. Bello

[57] ABSTRACT

A multiple resistive exerciser having a hydraulic resistive element and an elastomeric resistive element that are mounted between a frame and a movable member. The hydraulic element and elastomeric element provide a combined resistive force that opposes movement of the movable member in one direction and the elastomeric element provides a force which tends to move the member in an opposite direction.

19 Claims, 2 Drawing Sheets

ADJUSTABLE, MULTIPLE RESISTIVE FORCE EXERCISER

This application is a Continuation of application Ser. No. 08/048,211, filed Apr. 19, 1993, now abandoned, which is a Continuation of application Ser. No. 07/868,988, filed Apr. 15, 1992, now abandoned.

BACKGROUND OF THE INVENTION

1. Field of the Invention

The present invention relates to resistive exercisers and, more particularly, is directed towards resistive exercisers having adjustable, multiple resistive force elements.

2. Description of the Prior Art

Resistance exercise devices are used to simulate various activities such as rowing, cross-country skiing, and stair climbing. Generally, these exercisers utilize unidirectional resistive elements that provide a resistive force for arm and/or leg exercises. A typical stair-stepping type exercise device that uses a hydraulic device and provides a unidirectional resistive force is marketed by CSA, Inc. under the trademark ALPINE CLIMBER.

Although unidirectional resistance-type exercisers generally simulate particular activities, an exerciser that utilized multiple resistive force elements more closely simulates the natural feel of the particular activity.

A need has arisen for multiple resistive force exercisers that provide the natural feel of the activity for which the exerciser is designed to simulate.

SUMMARY OF THE INVENTION

It is an object of the present invention to provide a multiple resistive force exerciser.

It is another object of the present invention to provide an adjustable, multiple resistance force exerciser that provides a natural feel of a particular activity, such as stair climbing, rowing or skiing.

It is a further object of the present invention to provide a stair climbing exerciser with a pair of independently movable pedals and a pair of adjustable resistive force elements associated with each pedal to provide an adjustable, multiple resistive force exerciser.

It is yet a further object of the invention to provide a stair climbing exerciser with independently variable resistive force elements that provide the natural feel of climbing stairs. The stair climbing exerciser embodying the invention is characterized by a pair of foot pedals that are pivotally mounted at one end to an upright member. A hydraulic resistive member and an elastomeric resistive member are attached to each of the foot pedals and the upright member. The hydraulic member and the elastomeric member provide a combined resistive force against downward movement of the foot pedal and the elastomeric member pulls the depressed foot pedal upwardly. The hydraulic members and the elastomeric members are independently adjustable to provide multiple resistive forces.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings wherein.

DETAILED DESCRIPTION OF THE PREFERRED EMBODIMENTS

Figure 1:
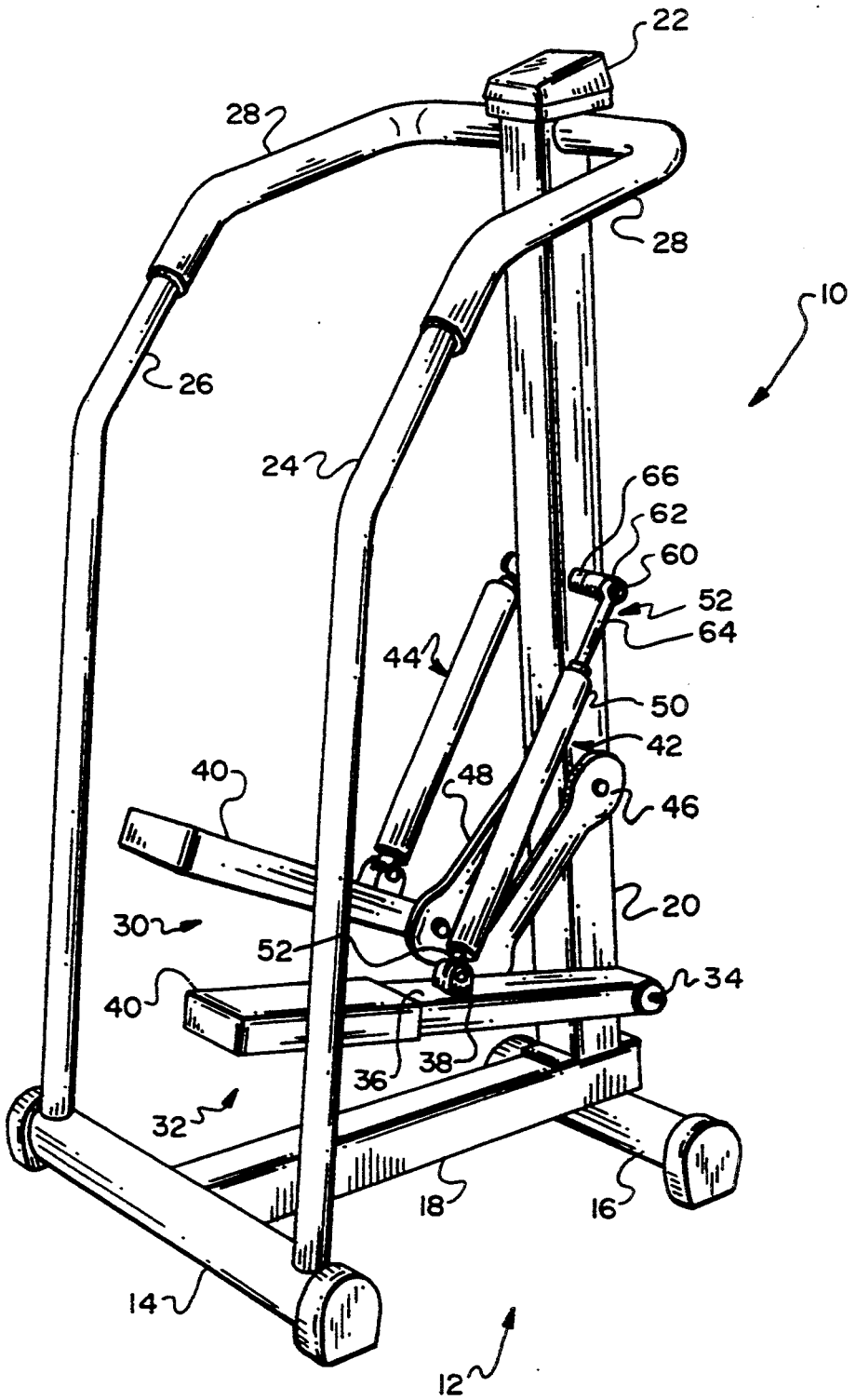
FIG. 1 is a perspective view of a multiple resistive exerciser embodying the invention.

Referring now to the drawings particularly FIG. 1, there is shown an adjustable, multiple resistive force exerciser 10 embodying the invention. Exerciser 10, for example a stair climbing exerciser, includes a base frame 12 formed from two parallel base supports 14 and 16 connected by a beam 18. An upright 20 extends substantially perpendicular from the base support 16. An exercise computer 22 is affixed to the free end of the upright 20 and provides information regarding the level of exercise being conducted by the user of the exerciser 10. Side rails 24, 26 provide support for the operator of the exerciser 10 and have opposing ends connected to the base support 14 as well as being connected to the upright 20. Padding 28, composed of a suitable non-slip material such as rubber, is positioned along the upper portions of the rails 24, 26. Left and right foot pedals 30 and 32, respectively, are pivotally mounted on upright 20 using a fastener 34 e.g., a pin or bolt. Foot pedals 30 and 32 have a substantially rectangular configuration. To prevent lateral movement of the foot pedals 30 and 32 along the length of the fastener 30, and to insure that the foot pedals 30 and 32 remain substantially parallel to each other, a spacer (not shown) is placed on the fastener between the adjacent surfaces of the foot pedals 30 and 32 and upright 20. Each foot pedal 30, 32 is provided with an adjustment slot 36, that is configured to receive a cylinder connection element 38 described in further detail below. A foot pad 40, composed of a non-slip material such as rubber, is positioned on the upper surface of the free end of foot pedals 30 and 32.

Multiple resistive is provided by hydraulic elements 42, 44 and elastomeric elements 46, 48. As hereinafter described, hydraulic element 42 and elastomeric element 46 are associated with foot pedal 32, and hydraulic element 44 and elastomeric element 48 are associated with foot pedal 30.

Hydraulic element 42 includes a cylinder 50 and a piston 52 that is constrained by reciprocal movement in the cylinder. The cylinder 50 of hydraulic element 42 is connected to foot pedal 32. A connector 52 at the lower end of cylinder 50 is pivotally connected to connecting element 38. A flange 56 (FIG. 2) extends within the adjustment slot 36 from the underside of the base of the connecting element 38. A locking knob 58 for fixing the position of the element 38 along adjustment slot 36 is attached to the end of flange 56. Once attached to the foot pedal 32, the position of the elements 38 can be altered by sliding it along the adjustment slot 36. Movement of the connecting element 38 toward the foot pad 40 increases the force required to move the foot pedals 30, 32 while movement away from the foot pad decreases the force required to move the foot pedals.

A bolt 60 fastens the piston 52 to the upright 20. Bolt 60 passes through upright 20 and an annular flange 62 that is at the end of a piston shaft 64 which extends out of cylinder 50. A spacer 66 is placed on the bolt 60 between the annular flanges 62 and upright 20. Hydraulic element 44 is identical to hydraulic element 42 and it is mounted to foot pedal 30 and upright 20 in the same manner just described for the mounting of hydraulic element 42 to foot pedal 32 and upright 20. Each hydraulic element 42, 44 provides a substantially unidirectional resistive force.

As previously indicated, elastomeric element 46 is associated with foot pedal 32 and elastomeric element 48 is associated with foot pedal 30. As best shown in FIGS. 3–6, elastomeric element 46 is an integral member having a pair of end flanges 70, 72 and a central body portion 74. In the illustrated embodiment, flanges 70 and 72 are substantially identical and each has a generally truncated tear drop configuration whose narrow end is at one end of body 74. Flanges 70 and 72 are provided with mounting holes 76 and 78, respectively. Flange 70 is attached to upright 20 by means of a fastener 80, for example a bolt, that passes through hole 76. Flange 72 is connected to foot pedal 30 by means of a fastener 82, for example a bolt, that passes through hole 78 and one of a series of holes 84 in foot pedal 30. The series of holes 84 is provided so that elastomeric element 46 can be positioned in various locations on foot pedal 30. The resistive force provided by elastomeric element 46 can be varied as a function of which hole 84 is used. Hole 84 nearest foot pad 40 provides a greater resistive force than the hole 84 nearest upright 20. Elastomeric element 48 is identical to elastomeric element 46 and is mounted and adjustable in a like manner as just described for elastomeric element 46. Elastomeric elements 46, 48 are composed of a natural or synthetic material such as rubber. Each elastomeric element 46 and 48 provides a substantially linear resistive force.

Figure 3:
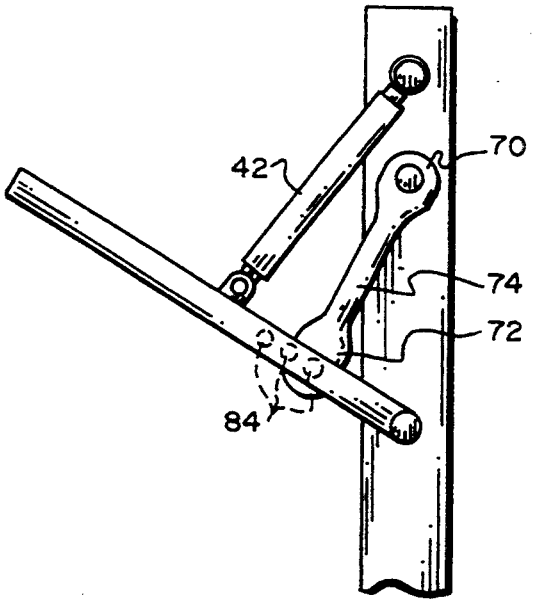
FIG. 3 is a schematic diagram of the foot pedal of FIG. 2 in its downward position.
Figure 2:
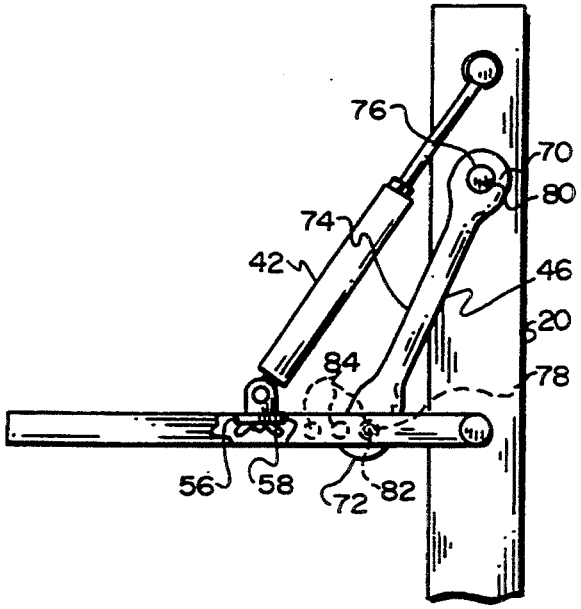
FIG. 2 is a schematic diagram of one of the foot pedals of FIG. 1 in its upward position; and the elastomeric resistive member.
Figure 5:
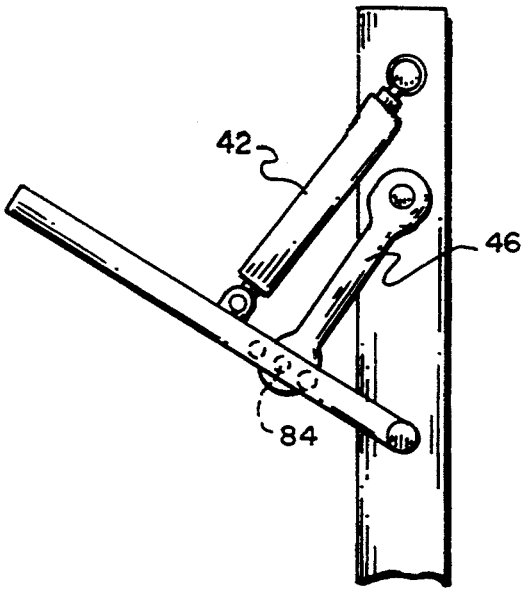
FIG. 5 is a schematic diagram showing the foot pedal of FIG. 4 in its downward position.
Figure 4:
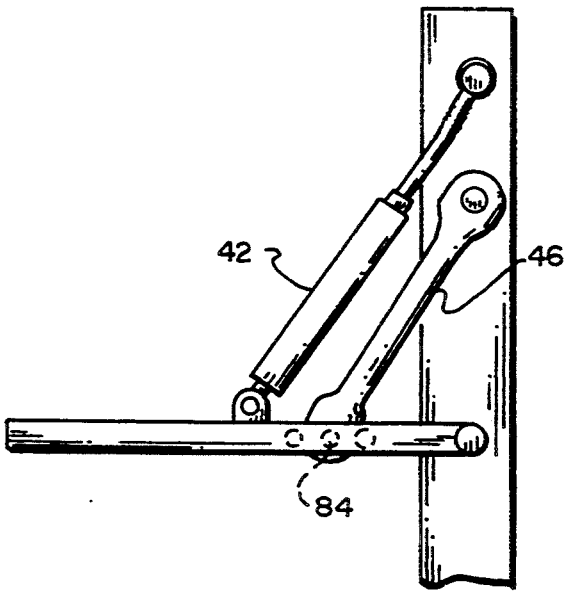
FIG. 4 is a schematic diagram similar to FIG. 2 with the elastomeric resistive member in a different location.

In operation, the user of the exercise apparatus 10 first sets the position of the cylinder connection elements 68 at the desired position along the adjustment slots 36, and set positions elastomeric elements 46 and 48 in one of the holes 84. FIGS. 2 and 3 show elastomeric element 46 in hole 48 nearest upright 20; and FIGS. 4 and 5 show the elastomeric element in the middle hole 84. It will be readily appreciated that, in alternative embodiments, the number of adjusting holes 84 is other than three, for example two or five. Next, the user places his or her feet on the foot pads 40 and begins to push either one of the foot pedals 30 and 32 downwardly. The user coordinates the downward movement of foot pedals 30 and 32 so that when one of the foot pedals is moved downwardly, the other foot pedal moves upwardly. This up and down pumping causes the cylinder 20 and piston 18 to move relative to each other with the length of the stoke of the piston 18 relative to the cylinder 20 being determined by position of the cylinder connection element 38 along the adjustment slot 66.

Hydraulic element 42 and elastomeric element 46 combine to provide a resistive force against downward movement of foot pedal 32. Elastomeric element 46 pulls foot pedal 32 upwardly from its depressed position. In a similar manner, hydraulic element 44 and elastomeric element 46 combine to provide a resistive force against downward movement of foot pedal 30. Elastomeric element 48 pulls foot pedal 30 upwardly.

From the foregoing, it will be readily appreciated that exercise device 10 is a multiple, resistive force exerciser having a plurality of independently adjustable resistive force elements and independently movable foot pedals 30 and 32. Each foot pedal 30 and 32 has a pair of resistive force elements, each of which is adjustable to provide multiple resistive forces, that provide combined forces that opposes downward movement of the foot pedals. At least one of the resistive force elements pulls the depressed foot pedals upwardly.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A multiple resistive force exerciser comprising:

(a) a frame;

(b) a pair of movable foot pedals pivotally connected to said frame, said movable foot pedals being reciprocally movable in opposite first and second directions relative to said frame;

(c) a first and a second resistive element associated with each said foot pedal;

(d) such first resistive element operatively connected to said frame and said movable foot pedals, said first resistive element providing a substantially unidirectional resistive force, said unidirectional resistive force provided by said first resistive element being substantially constant and changing only nominally as said movable foot pedal is moved in said first direction relative to said frame; and (e) said second resistive element operatively connected to said frame and said movable foot pedal, said second resistive element being connected to said movable member at a position different from said position at which said movable foot pedal is connected to said frame, said second resistive element providing a bidirectional resistive force, said bidirectional resistive force being provided by said second resistive element when said movable foot pedal is reciprocally moved in said first and said second directions relative to said frame, said second resistive element providing a resistive force when said movable foot pedal is moved in said first direction and an assistive force when said movable member is moved in said second direction, the resultant resistive force provided by said first resistive element and said second resistive element is greater in said first direction than the resultant of said resistive force provided by said first resistive element and said assistive force provided by said second resistive element in said second direction, the resultant resistive force opposing movement of said movable foot pedal in said first direction is greater that the resultant of said resistive and assistive forces;

(e) said resistive forces provided by said first and second resistive elements combining to provide a combined resistive force which resists movement of said movable foot pedal in said first direction;

(f) said assistive force provided by said second resistive element being sufficient to move said movable foot pedal in said second direction against said resistive force of said first resistive element.

2. The multiple resistive exerciser as claimed in claim 1 wherein said first resistive element is a hydraulic resistive element.

3. The multiple resistive exerciser as claimed in claim 1 wherein said second resistive element is an elastomeric resistive element.

4. The multiple resistive exerciser as claimed in claim 1 wherein said first resistive element is a hydraulic resistive element and said second resistive element is an elastomeric resistive element.

5. The multiple resistive exerciser as claimed in claim 4 wherein said elastomeric element includes an elongated body portion with enlarged flanges at opposite ends of said body portion.

6. The multiple resistive exerciser as claimed in claim 5 wherein said elastomeric element is composed of rubber.

7. The multiple resistive exerciser as claimed in claim 1 wherein each of said first and second resistive elements is adjustable to provide at least two different resistive forces.

8. A multiple resistive exerciser comprising:

(a) a frame having a base and an upright;

(b) a pair of independently movable foot pedals, each said foot pedal having a mounting member at one end and a foot pad at an opposite end, said mounting ends pivotally connected to said upright, said foot pedals mounted on opposite sides of said upright, said foot pedals pivotally movable in opposite first and second directions;

(c) a pair of first resistive elements, one of each said first resistive elements operatively connected to said upright and one of said foot pedals, said first resistive elements providing a resistive force on each said foot pedal when each said foot pedal is moved in said first and said second direction, said resistive force produced by said first resistive elements being substantially constant and changing only nominally as each of said foot pedals is moved in said first direction relative to said frame;

(d) a pair of second resistive elements, one of each said second resistive elements operatively connected to said upright and one of said foot pedals, each of said second resistive elements being connected to one of said foot pedals at a position different from said position at which each said foot pedal is connected to said frame, said second resistive elements providing a resistive force on each said foot pedal when each said foot pedal is moved in said first direction and an assistive force when each said foot pedal is moved in said second direction, said resistive force and said assistive force being provided by said second resistive elements when each of said foot pedals is pivotally moved in said first and said second directions relative to said frame, the resultant resistive force provided by said first resistive elements and said second resistive elements that acts against movement in said first direction is greater than the resultant of said resistive and assistive forces acting against movement in said second direction;

(e) said resistive forces provided by said first and second resistive elements combining to provide a combined resistive force which opposes movement of each said foot pedals in said first direction;

(f) said assistive force provided by each of said second resistive elements being sufficient to move each of said foot pedals in said second direction against said resistive force of each said first resistive elements.

9. The multiple resistive exerciser as claimed in claim 8 wherein said first resistive elements are hydraulic resistive elements.

10. The multiple resistive exerciser as claimed in claim 8 wherein said second resistive elements are elastomeric resistive elements.

11. The multiple resistive exerciser as claimed in claim 8 wherein each said first resistive elements is a hydraulic resistive element and each said second resistive element is an elastomeric resistive element.

12. The multiple resistive exerciser as claimed in claim 11 wherein each said elastomeric element includes an elongated body portion with enlarged flanges at opposite ends of said body portion.

13. The multiple resistive exerciser as claimed in claim 12 wherein each said elastomeric element is composed of rubber.

14. The multiple resistive exerciser as claimed in claim 8 wherein each of said first resistive elements is independently adjustable to provide at least two different resistive forces.

15. The multiple resistive exerciser as claimed in claim 8 wherein each of said second resistive elements is independently adjustable to provide at least two different resistive forces.

16. An adjustable, multiple resistive exerciser comprising:

(a) a frame;

(b) a pair of independently movable foot pedals operatively connected to said frame, each said movable foot pedals being reciprocally movable in opposite first and second directions relative to said frame;

(c) a pair of hydraulic resistive elements, each said hydraulic resistive element, adjustably operatively connected to said frame and one of said movable foot pedals, each said hydraulic resistive element providing a substantially unidirectional, resistive force in said first direction, said resistive force remaining substantially constant and changing only nominally as said movable foot pedals is moved in said first direction; and (d) a pair of elastomeric resistive elements, each said elastomeric resistive element, adjustably operatively connected to said frame and one of said movable foot pedals, each of said elastomeric resistive elements being connected to one of said movable foot pedals at a position different from said position at which said movable foot pedals is connected to said frame, each said elastomeric resistive element providing a bidirectional force, said elastomeric resistive element providing a resistive force when each said movable foot pedals is moved in said first direction and an assistive force when each said foot pedal is moved in said second direction, said resistive force and said assistive force being provided by said elastomeric resistive elements when said movable foot pedals is reciprocally moved in said first and said second directions, the resultant resistive force provided by said hydraulic resistive elements and said elastomeric resistive elements is greater in said first direction than the resultant of said resistive force provided by said hydraulic resistive elements and said assistive resistive force provided by said elastomeric resistive element in said second direction, the resultant resistive force opposing movement of each said movable foot pedals in said first direction is greater that the resultant resistive force opposing movement of each said movable foot pedals in said second direction;

(e) said resistive forces provided by said hydraulic resistive elements and said elastomeric resistive elements combining to provide combined resistive forces that oppose movement of said movable foot pedals in said first directions;

(f) said assistive force provided by each of said elastomeric resistive elements being sufficient to move said movable foot pedals in said second direction against said resistive force of said hydraulic resistive elements.

17. The multiple resistive exerciser as claimed in claim 16 wherein each of said hydraulic resistive elements is independently adjustable to provide at least two different resistive forces.

18. The multiple resistive exerciser as claimed in claim 16 wherein each of said elastomeric resistive elements is independently adjustable to provide at least two different resistive forces.

19. The multiple resistive exerciser as claimed in claim 16 wherein each of said hydraulic resistive elements is independently adjustable to provide at least two different resistive forces and each of said elastomeric resistive elements is independently adjustable to provide at least two different resistive forces.

* * * * *